US008378529B2

(12) United States Patent
Hani et al.

(10) Patent No.: US 8,378,529 B2
(45) Date of Patent: Feb. 19, 2013

(54) SWITCHING ACTUATOR FOR CONTROLLING THE ENERGY SUPPLY TO ELECTRIC CONSUMERS

(75) Inventors: Michael Hani, Bad Albling (DE); Holger Kraus, Ohlstadt (DE); Axel Pilz, Neuenstein (DE)

(73) Assignee: OSRAM Gesellschaft mit beschrankter Haftung, Munich (DE)

( * ) Notice: Subject to any disclaimer, the term of this patent is extended or adjusted under 35 U.S.C. 154(b) by 505 days.

(21) Appl. No.: 12/522,866

(22) PCT Filed: Jan. 10, 2007

(86) PCT No.: PCT/EP2007/050222

§ 371 (c)(1), (2), (4) Date: Jul. 10, 2009

(87) PCT Pub. No.: WO2008/083854

PCT Pub. Date: Jul. 17, 2008

(65) Prior Publication Data

US 2010/0001591 A1 Jan. 7, 2010

(51) Int. Cl.
*H01H 9/54* (2006.01)

(52) U.S. Cl. ..... 307/140; 307/139; 307/143

(58) Field of Classification Search ..... 307/140, 307/139, 143

See application file for complete search history.

(56) References Cited

U.S. PATENT DOCUMENTS

| | | | | |
|---|---|---|---|---|
| 6,297,724 | B1 | 10/2001 | Bryans et al. | |
| 6,762,570 | B1 * | 7/2004 | Fosler | 315/312 |
| 7,705,546 | B2 * | 4/2010 | Juen | 315/307 |

FOREIGN PATENT DOCUMENTS

| | | |
|---|---|---|
| GB | 104000 | 2/1917 |
| GB | 2 368 169 | 4/2002 |
| WO | WO 02/082618 | 10/2002 |
| WO | WO 2005/004552 | 1/2005 |
| WO | WO 2006074630 A1 * | 7/2006 |

* cited by examiner

*Primary Examiner* — Hal Kaplan
(74) *Attorney, Agent, or Firm* — Cozen O'Connor

(57) ABSTRACT

A switching actuator for controlling the energy supply to at least one electrical consumer (102) with an energy supply input (142), an energy supply output (144), a signal line input (146), a signal line output (148) and an evaluation unit (154), the evaluation unit (154) being adapted to activate or deactivate the energy supply output (144) on the basis of signals input via the signal line input (146).

13 Claims, 2 Drawing Sheets

SWITCHING ACTUATOR FOR CONTROLLING THE ENERGY SUPPLY TO ELECTRIC CONSUMERS

RELATED APPLICATIONS

Figure 1:
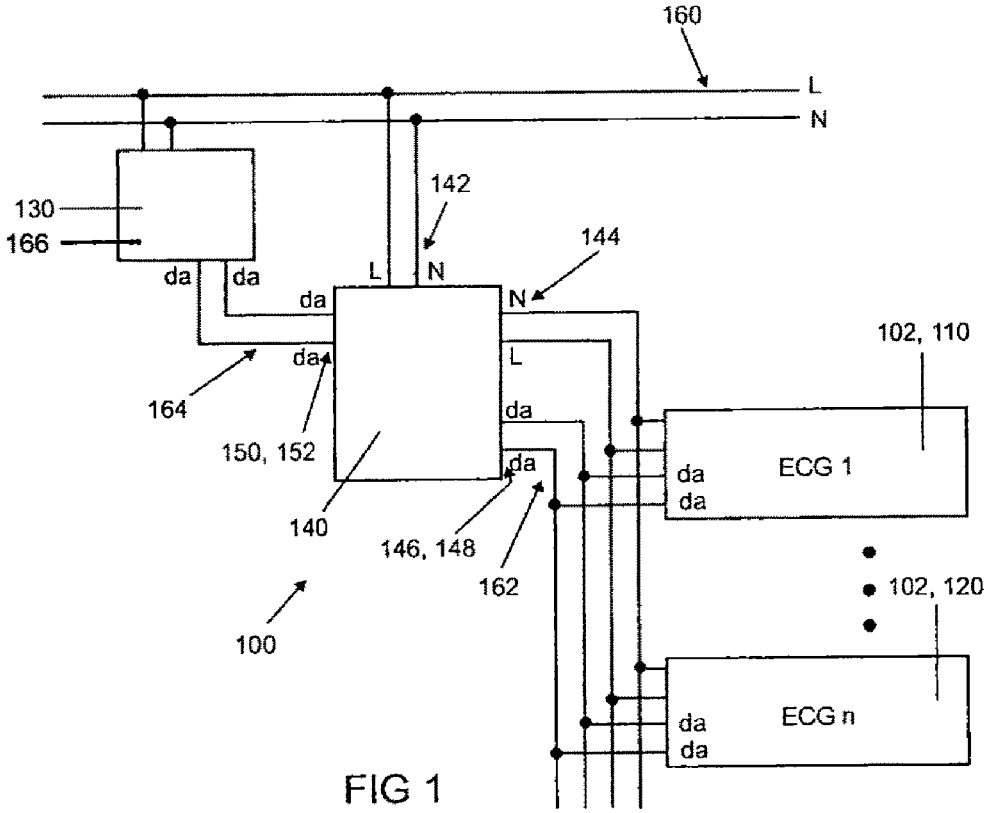

This is a U.S. national stage of application No. PCT/EP2007/050222, filed on Jan. 10, 2007.

FIELD OF THE INVENTION

The invention relates to a switching actuator for controlling the energy supply to electrical consumers, in particular to control gear, which correspond to the interface definition "Digital Addressable Lighting Interface" (DALI).

BACKGROUND OF THE INVENTION

Nowadays light has become a contributing factor to the comfort of rooms and a contributing factor in energy saving concepts in facility management. Stringent requirements are therefore placed on modern lighting systems both in terms of their functionality and in terms of their energy efficiency.

Recent lighting systems have in the meantime been realized predominantly with the aid of so-called DALI operating devices. DALI itself is an interface definition for digital standardized communication (IEC 62386) between lighting control components and electronic control gear (ECG) for different luminous means. The communication between control devices and ECG in this case takes place via a two-wire line. An essential feature of a DALI system is the addressability of the ECGs, i.e. the control gear are generally connected to one and the same two-core control line, but, after the assignment of an individual address, can be driven separately or split into separately controllable groups. In a DALI system, only control components should always automatically transmit commands on this line; they are "masters" in a DALI system. On the other hand, ECGs do not produce any commands, but should only respond to a query from a master. ECGs are therefore so-called "slaves".

Specifically, the query is made to the ECG as follows:

The master transmits any desired query, for example "luminous means defect?", to one or more ECGs and expects a response directly after transmission of the query within a very short defined time window. Outside this time window, responses are rejected as being invalid.

The query by the master can take place, as is also the case for other DALI commands, at any desired time, which means that the ECGs must always be communication-ready. The ECGs therefore need to be continuously supplied with energy. This applies in particular also when the luminous means of an ECG has been switched off by a DALI command and is in the standby mode.

The above described permanent energy supply to ECGs results in a high, undesired energy consumption in the standby mode, in particular in the case of large lighting systems.

In order to reduce the energy consumption in the standby mode, relatively large lighting systems are isolated from the power supply system manually or via time switches when it is ensured that they are not required (for example at night time). During conventional usage times of the system, however, all of the system components are supplied with energy from the power supply system. Unused system components are then in the standby mode and thus cause an undesirable additional energy consumption.

Manual isolation of the lighting system from the power supply system, or isolation controlled via time switches, as has previously been practiced, in order to save energy also has the disadvantage that the lighting system can only be activated by additional working steps, if said lighting system is required in an exception case during this time.

SUMMARY OF THE INVENTION

One object of the invention is to provide an apparatus which makes it possible to reduce the energy consumption of lighting systems in the standby mode without impairing the operational convenience of the lighting system.

In accordance with one aspect of the invention, a switching actuator with an energy supply input, an energy supply output, a signal line input, a signal line output and an evaluation unit is provided for controlling the energy supply to at least one electrical consumer, the evaluation unit being designed to activate or deactivate the energy supply output on the basis of signals input via the signal line input.

Such a switching actuator can be switched between a control unit and downstream electronic control gear, for example, in the case of existing lighting systems. Signals can be received by a control unit via the signal line input of the switching actuator. These signals are transmitted via the signal line output from the switching actuator to the electronic control gear. The supply of energy to the downstream electronic control gear takes place with the aid of the evaluation unit, which is designed to activate or deactivate the energy supply output on the basis of signals from the control unit. This has the advantage that consumers which are connected downstream of the switching actuator via the signal line output only need to be supplied with energy when this is necessary. As soon as the control devices no longer transmit a switch-on signal, the energy supply can be interrupted with the aid of the switching actuator.

A switching actuator according to the invention can therefore be used to avoid the energy consumption of downstream consumers in a standby mode by virtue of the fact that only the switching actuator needs to be supplied with energy, instead of all of the electronic control gear. The switching actuator identifies, with the aid of the signal input, when electronic control gear need to be supplied with energy and therefore performs the function of controlling the energy supply. The energy consumption in the standby mode can thus be markedly reduced in particular in the case of large lighting systems. The switching actuator according to the invention can not only be used in lighting systems, but is suitable for controlling the energy supply to any electrical consumer.

In a preferred embodiment of the invention, the signal line input and the signal line output have bidirectional connections. This has the advantage that information can be transmitted not only from a control device connected via the signal line input to the consumers, but also feedback can be given from the consumers to the switching actuator or the control device. This embodiment is therefore suitable for example for systems with control devices which are designed to request information from connected consumers and therefore require a feedback option.

If the signal line input and the signal line output each have two-wire lines corresponding to the DALI standard, the switching actuator can be combined with all of the control devices and consumers of the DALI standard without any further adaptation measures. Since DALI is a manufacturer-independent standard, the switching actuator can in this case be combined with virtually all already existing DALI systems, with it also being possible with only a small amount of complexity to extend existing DALI systems simply by interposing a switching actuator according to the invention and thereby considerably reducing the energy consumption of such systems.

In a further preferred embodiment of the invention, the evaluation unit for activating or deactivating the energy supply output has a connection to a switching element, it being possible for a connection to be produced between the energy supply input and the energy supply output via the switching element. Such an evaluation unit can be produced inexpensively and so as to be very compact. In particular, a simple relay can be used as the switching element.

In accordance with the abovedescribed embodiments, the energy supply to all of the electronic control gear or other electrical consumers is deactivated if no electronic control gear or no other electrical consumer is used. In addition, the energy supply to all of the electronic control gear or other electrical consumers is (re)activated if only one electronic control gear or only one other electrical consumer is intended to be activated. Even this simple embodiment results in considerable savings in terms of energy consumption.

In another embodiment, the evaluation unit is designed to check addresses and/or group assignment of electrical consumers or to evaluate the group assignment during a commissioning phase. The knowledge of the group assignment or the addresses makes it possible to drive individual consumers or individual groups of electrical consumers. As a result, the energy supply to individual consumers or individual groups of electrical consumers can be deactivated by the switching actuator if the corresponding consumer or no electrical consumer of the corresponding group is intended to be used. Since additional deactivation possibilities are opened up in this embodiment, the energy consumption can be further reduced with this embodiment.

In a further preferred embodiment, the evaluation unit is designed to transmit signals to predetermined addresses and/or groups via the signal line output. As a result, activation of only specific electrical consumers or electronic control gear can take place. This could be realized, for example, in a lighting system with a switching actuator as follows. If all of the electronic control gear are deactivated, i.e. have a dimming setting=0, the evaluation unit isolates the electronic control gear from the energy supply. That is to say that only the energy requirement of the switching actuator is required. As soon as the switching actuator receives a signal above a dimming setting greater than 0, the switching actuator transmits a "broadcast OFF" signal to all of the electronic control gear which are not intended to be activated directly after activation of the energy supply for 600 ms, for example. This signal has the effect that, owing to the activation of the energy supply, the luminous means of specific control gear are prevented from being switched on if not required. Since the control gear are only reception-ready again after activation of the energy supply, the evaluation unit of the switching actuator repeats control signals at the signal line output.

If the evaluation unit has a monitoring unit and a status memory, the switching actuator can query the status of electronic control gear in cyclic intervals and store this status. In this case, it is sufficient if only the switching actuator is assigned an address or group assignment during a commissioning phase. Outside the commissioning phase, the switching actuator does not pass on signals directly to the electronic control gear, but it monitors the electronic control gear itself as being representative of the electronic control gear. The status of the electronic control gear therefore does not need to be queried by the transmission of queries to the electronic gear in this embodiment, but is available as stored information in the status memory. Thus, the response time of the lighting system can be reduced and the operational convenience increased.

In another embodiment of the invention, the evaluation unit has inner logic, by means of which the energy supply input can be activated or deactivated on the basis of signals detected at the signal line input. In this embodiment, the switching actuator does not itself decide whether the electronic control gear need to be supplied with energy. Instead, one or more specific signal responses (commands) are assigned to the switching actuator, and the energy supply to the electronic control gear is activated or deactivated on the basis of said signal responses. Such logic could bring about disconnection in the event of the signal "broadcast OFF" being received and reconnection in the event of a light setting callup which is addressed as desired being received, for example. Particularly preferably, in this embodiment the evaluation unit is also designed to transmit signals to predetermined addresses and/or groups via the signal line output, with the result that electronic control gear which are not to be activated can be prevented from being switched on in an undesired manner, for example by the transmission of an "OFF" signal to said control gear. This embodiment has the advantage that the switching response can be matched individually and therefore particularly precisely to the requirements of a lighting system. In addition, the evaluation unit can have a particularly simple design and compact configuration since only a small amount of physical space is required for the functions.

The switching actuator can either be connected as a separate component part between a control unit and electrical consumers or integrated in the control unit. The integration of the switching actuator has the advantage that the design of a lighting system is no more complex than in the case of light systems known from the prior art without a switching actuator. However, if an already existing lighting system is intended to be subsequently provided with a switching actuator, it is advantageous if the switching actuator is present in the form of a separate component part, since in this case it can easily be connected additionally between the control unit and the electrical consumer.

The advantages of the invention are also correspondingly demonstrated in the case of systems for controlling the energy supply to electrical consumers comprising a control unit and at least one electrical consumer, with a switching actuator according to the invention being arranged between the control unit and the electrical consumer.

BRIEF DESCRIPTION OF THE DRAWING(S)

Figure 2:
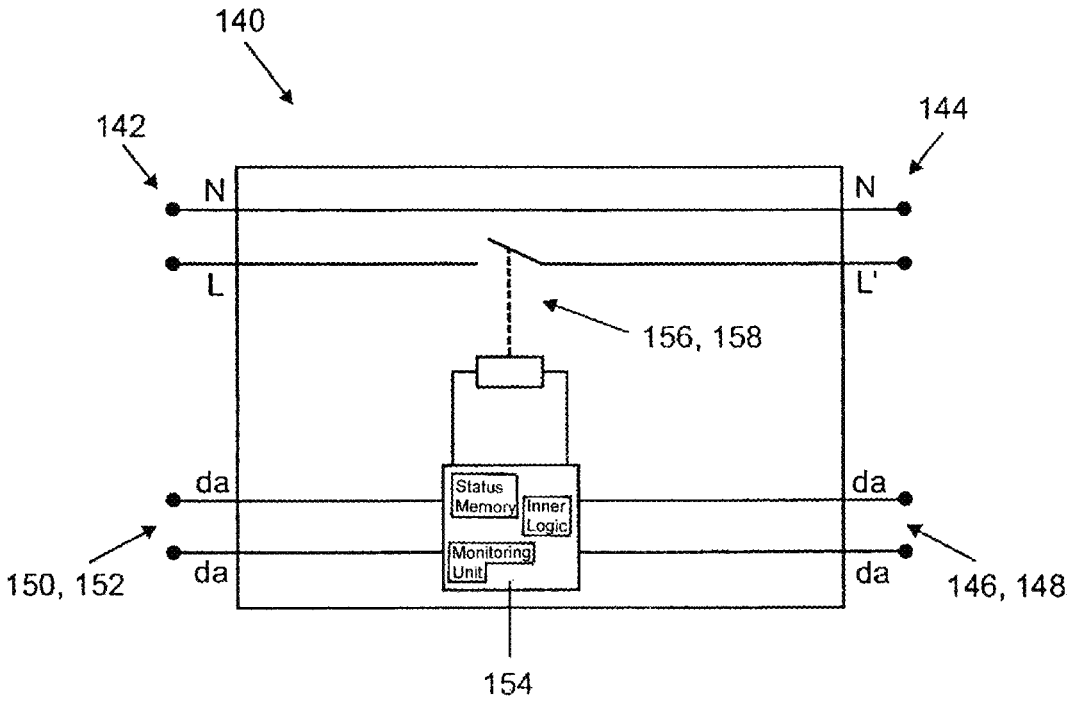

The invention will be explained in more detail below with reference to an exemplary embodiment. In the figures:

FIG. 1 shows a circuit diagram of a system according to the invention for controlling the energy supply to electronic control gear with a switching actuator according to the invention, and FIG. 2 shows a detailed sketch of the design of the switching actuator shown in FIG. 1.

DETAILED DESCRIPTION OF THE DRAWINGS

FIG. 1 shows a system 100 according to the invention for controlling the energy supply to electrical consumers 102, with in this case the electrical consumers 102 being electronic control gear "ECG 1" 110 to "ECG n" 120. The system comprises, in addition to the electronic control gear 110, 120, a control unit 130 and a switching actuator 140 according to the invention.

The switching actuator 140 according to the invention, which can be seen in detail in FIG. 2, has an energy supply input 142 and an energy supply output 144. In addition, the switching actuator 140 has a signal line input 146, 150 and a signal line output 148, 152. The signal line input 146, 150 and the signal line output 148, 150 are bidirectional two-wire lines, which correspond to the DALI standard.

The signal line input 146 and the signal line output 148 are connected to one another via an evaluation unit 154.

A first DALI line 164, which connects the switching actuator 140 to the control unit, is connected to the signal line input 146. A second DALI line 162, which connects the switching actuator 140 to the electronic control gear 110, 120, is connected to the signal line output. For easier understanding, the DALI lines 162, 164 have been provided with the designation "da".

The evaluation unit 154 is designed to activate or deactivate the energy supply output 144 on the basis of signals input via the signal line input by means of the switching element 156, which is a relay 158 in the example shown in FIG. 2.

In the embodiment of the system according to the invention shown in FIG. 1, the switching actuator 140 is a separate component part, which is connected directly to a power supply system 160 via the energy supply input 142.

The control unit 130, which is likewise connected directly to the power supply system 160 via a separate energy supply line 166, is therefore only connected to the switching actuator via a DALI line.

It will once again be emphasized that it is possible to integrate the switching actuator in the control unit and/or not to connect the switching actuator directly to the power supply system 160, but to supply the switching actuator with energy from the control unit.

In the case of the system 100 shown in FIG. 1, all of the electronic control gear 110, 120 are connected to the second DALI line 162. All of the electronic control gear 110, 120 are assigned addresses and a group assignment during commissioning in order to be able to operate said electronic control gear independently of other electronic control gear which are likewise connected to the second DALI line 162. During commissioning, the switching element 156 is closed, with the result that all of the downstream electronic control gear 110, 120 are supplied with energy and are communication-ready, and a direct communication between the control unit and the control gear for address distribution and/or group assignment is possible. The switching actuator itself acts during the commissioning as a DALI subscriber and is assigned all groups to which downstream electronic control gear 110, 120 also belong.

Outside the commissioning mode, the switching actuator 140, by evaluation of the signals transmitted via the DALI lines 162, 164, identifies the dimming setting or the switching state of the downstream electronic control gear. As long as at least one group has a dimming setting >0, the switching element 156 remains closed, and the electronic control gear 110, 120 are supplied with energy and information originating from the control device.

As soon as a DALI signal in this state ensures that all groups assume the dimming setting=0, i.e. are switched off, the switching element 156 deactivates the energy supply, as a result of which the electronic control gear 110, 120 are isolated from the power supply system. In this state, only the standby energy requirement of the switching actuator is now required.

As soon as the actuator receives DALI signals which require a dimming setting of >0 for at least one of the downstream groups of electronic control gear, the switching element 156 activates the energy supply, repeats the received DALI signal and, by means of transmitting corresponding "OFF" signals, prevents luminous means of unaffected electronic control gear being switched on in an undesired manner.

During normal operation, DALI signals received by the switching actuator are output at the signal output 148 at a ratio of 1:1, i.e. without a delay or change in the signal.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A switching actuator for controlling the energy supply to at least one electrical consumer with an energy supply input, an energy supply output, a signal line input, a signal line output and an evaluation unit, the evaluation unit being adapted to activate or deactivate the energy supply output on the basis of signals input via the signal line input;

wherein, when the switching actuator receives a signal above a dimming setting of 0, the switching actuator transmits a "broadcast OFF" to all of each of the at least one electrical consumer not intended to be activated directly after activation of the energy supply.

2. The switching actuator as claimed in claim 1, wherein the signal line input and a signal line output have bidirectional connections.

3. The switching actuator as claimed in claim 2, wherein the signal line input and the signal line output each have two-wire lines corresponding to the DALI standard.

4. The switching actuator as claimed in claim 1, wherein the evaluation unit for activating or deactivating the energy supply output has a connection to a switching element, it being possible for a connection to be produced between the energy supply input and the energy supply output via the switching element.

5. The switching actuator as claimed in claim 4, wherein the switching element is a relay.

6. The switching actuator as claimed in claim 1, wherein the evaluation unit is adapted to check addresses and/or group assignment of electrical consumers or to record said addresses and/or group assignment in a commissioning phase.

7. The switching actuator as claimed in claim 6, wherein the evaluation unit is adapted to transmit signals to predetermined addresses and/or groups via the signal line output.

8. The switching actuator as claimed in claim 1, wherein the evaluation unit comprises a monitoring unit and a status memory.

9. The switching actuator as claimed in claim 1, wherein the evaluation unit has inner logic with which the energy supply output can be activated or deactivated based on signals detected at the signal line input.

10. A control unit, comprising a switching actuator as claimed in claim 1.

11. A system for controlling the energy supply to electrical consumers comprising a control unit and at least one electrical consumer, and a switching actuator as claimed in claim 1 is arranged between the control unit and the electrical consumer.

12. The system as claimed in claim 10, wherein at least one electrical consumer is electronic control gear, and the evaluation unit is adapted to check the dimming setting of electronic control gear.

13. A switching actuator for controlling the energy supply to at least one electrical consumer with an energy supply input, an energy supply output, a signal line input, a signal line output and an evaluation unit, the evaluation unit being adapted to activate or deactivate the energy supply output on the basis of signals input via the signal line input;

wherein, when the switching actuator receives a DALI signal which requires a dimming setting of >0 for at least one downstream group of electronic control gear, a switching element of the switching actuator activates the energy supply, repeats the received DALI signal and transmits corresponding "OFF" signals to prevent a luminous device of unaffected electronic control gear from being switched on in an undesired manner.

* * * * *